US007490380B2

(12) United States Patent
Terao

(10) Patent No.: US 7,490,380 B2
(45) Date of Patent: Feb. 17, 2009

(54) CLEANING TOOL FOR PHOTOGRAPHIC DEVICE

(75) Inventor: Yuji Terao, Saitama (JP)

(73) Assignee: Hoya Corporation, Tokyo (JP)

( * ) Notice: Subject to any disclaimer, the term of this patent is extended or adjusted under 35 U.S.C. 154(b) by 0 days.

(21) Appl. No.: 11/777,590

(22) Filed: Jul. 13, 2007

(65) Prior Publication Data

US 2008/0010763 A1 Jan. 17, 2008

(30) Foreign Application Priority Data

Jul. 14, 2006 (JP) ..... 2006-194343

(51) Int. Cl.
*A47L 25/00* (2006.01)

(52) U.S. Cl. ..... 15/104.002

(58) Field of Classification Search ..... 15/104.002, 15/244.1

See application file for complete search history.

(56) References Cited

U.S. PATENT DOCUMENTS

| | | | | |
|---|---|---|---|---|
| 2,708,761 | A * | 5/1955 | Bergquist | 15/104.002 |
| 2,736,911 | A * | 3/1956 | Larsen | 15/210.1 |
| 2,755,494 | A * | 7/1956 | Bredin | 15/104.002 |
| 3,797,875 | A * | 3/1974 | den Hamer | 294/1.1 |
| 4,073,530 | A * | 2/1978 | Seidler | 294/19.1 |
| 4,085,838 | A * | 4/1978 | Pierce | 400/696 |
| 5,181,755 | A * | 1/1993 | Stanwich et al. | 294/1.1 |
| 5,765,887 | A * | 6/1998 | Weichman et al. | 294/1.1 |
| 6,175,984 | B1 * | 1/2001 | Prime et al. | 15/104.002 |
| 6,896,741 | B2 * | 5/2005 | Stelcher | 134/6 |
| 6,901,622 | B2 * | 6/2005 | Thompson et al. | 15/104.002 |
| 7,047,586 | B2 * | 5/2006 | Shimada et al. | 15/104.002 |

FOREIGN PATENT DOCUMENTS

| | | |
|---|---|---|
| JP | 6-063183 U | 9/1994 |
| JP | 3022843 U | 1/1996 |
| JP | 3042014 U | 7/1997 |
| JP | 2005-334525 | 12/2005 |
| JP | 2006-000134 | 1/2006 |
| JP | 2006-006690 | 1/2006 |

OTHER PUBLICATIONS

U.S. Appl. No. 11/777,626,to Terao, filed Jul. 13, 2007.

* cited by examiner

*Primary Examiner*—Randall Chin
(74) *Attorney, Agent, or Firm*—Greenblum & Bernstein, P.L.C.

(57) ABSTRACT

A cleaning tool is to remove foreign matter from a surface of a photographic device. The cleaning tool includes an adhesive member and a stick body. The adhesive member has an adhesive surface for the foreign matter to adhere to. The stick body has an end to which the adhesive member is attached. The adhesive surface has an arcuate area, of which part of the outline is an arcuate section and a rectangular area that has a rectangular shape. The arcuate area is located between two theoretical lines which extend from two adjoining sides of the rectangular area.

8 Claims, 6 Drawing Sheets

CLEANING TOOL FOR PHOTOGRAPHIC DEVICE

BACKGROUND OF THE INVENTION

1. Field of the Invention

The present invention relates to a cleaning tool for a photographic device, and especially to a cleaning tool for removing foreign matter attached to a member of a digital camera which has interchangeable lenses or other devices.

2. Description of the Related Art

Recently, the number of digital cameras with interchangeable lenses has been increasing. In an interchangeable lens digital camera, foreign matter such as dust which enters into it when the lens is changed, may become attached to a surface of an imaging device inside the digital camera. In such a case, removing the foreign matter from the surface of the imaging device is required to prevent the deterioration of the image quality due to foreign matter. Further, in photographic devices such as a digital camera, cleaning a photographing lens, an eyepiece, a view finder, or so on, is sometimes required.

On the other hand, a cleaning tool that is used for cleaning a precision instrument, an electron device, or so on, and that has an adhesive member used to remove foreign matter from a surface to be cleaned, is already known.

A conventional cleaning tool which uses an adhesive member is not necessarily suited to cleaning a photographic device such as a digital camera. Therefore, such a conventional cleaning tool is not generally suitable for cleaning imaging devices and so on. For example, a widely-used cleaning tool, which has an adhesive member having a circle-shaped front end surface is not suitable for cleaning rectangular surfaces such as a surface of an imaging device or other devices.

On the other hand, in the case when a cleaning tool is made for cleaning an imaging device or so on, cleaning the photographing lens, eyepiece, view finder, or other devices which have a circular shape differing from that of an imaging device, is difficult.

SUMMARY OF THE INVENTION

Therefore, an object of the present invention is to provide a cleaning tool for a photographic device that can effectively clean various members provided in a photographic device, such as an imaging device.

A first cleaning tool, according to the present invention, is used for removing foreign matter from a surface of a photographic device. The cleaning tool includes an adhesive member and a body. The adhesive member has an adhesive surface for the foreign matter to adhere to. The body has an end to which the adhesive member is attached. The adhesive surface has an arcuate area, of which part of the outline is an arcuate section, and a rectangular area that has a rectangular shape. The arcuate area is located between two theoretical lines which extend from two adjoining sides of the rectangular area.

The outline of the arcuate area may further include a linear section, and the linear section maybe coincident with a side of the rectangular area. The arcuate area may have a semicircular shape.

The adhesive surface may be perpendicular to the direction in which the body extends. The sectional shape of the adhesive member taken along a plane perpendicular to the longitudinal direction of the body may have a similar shape to the adhesive surface. The body may have a stick shape and may be a holding part to be held by a user.

A second cleaning tool, according to the present invention, is used to remove foreign matter from a surface of a photographic device. The cleaning tool includes an adhesive member and a body. The adhesive member has an adhesive surface for the foreign matter to adhere to. The body has an end to which the adhesive member is attached. The adhesive surface has an arcuate area, of which part of the outline is an arcuate section, and a right-angle area that includes a right-angle. The arcuate area is located next to the right-angle area and between two theoretical lines which extend from the two sides of the right-angle area which are adjacent to the right angle.

Either end of the arcuate section may connect to the opposite end to the right angle of both the two sides of the right-angle area.

A third cleaning tool, according to the present invention, is used to remove foreign matter from a surface of a photographic device. The cleaning tool includes an adhesive member and a body. The adhesive member has an adhesive surface for the foreign matter to adhere to. The body has an end to which the adhesive member is attached. The adhesive surface has an arcuate area, of which part of the outline is an arcuate section, and a rectangular area that has a rectangular shape. The arcuate area is located between two theoretical lines which extend from either end of two opposite sides of the rectangular area.

BRIEF DESCRIPTION OF THE DRAWINGS

The present invention will be better understood from the description of the preferred embodiments of the invention set forth below together with the accompanying drawings, in which.

DESCRIPTION OF THE PREFERRED EMBODIMENTS

Hereinafter, the preferred embodiments of the present invention are described with reference to the attached drawings.

Figure 1:
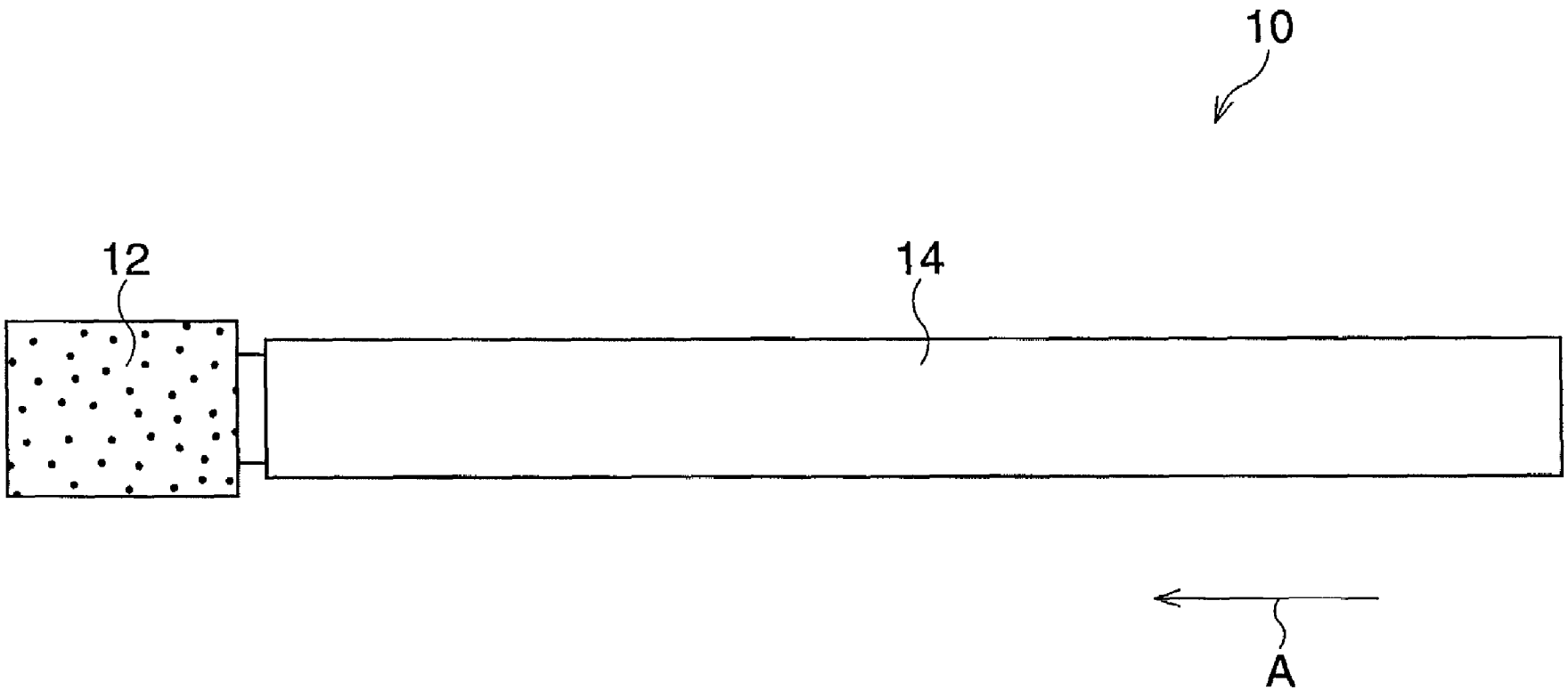
FIG. 1 is a side view of the cleaning tool of the first embodiment.
Figure 2B:
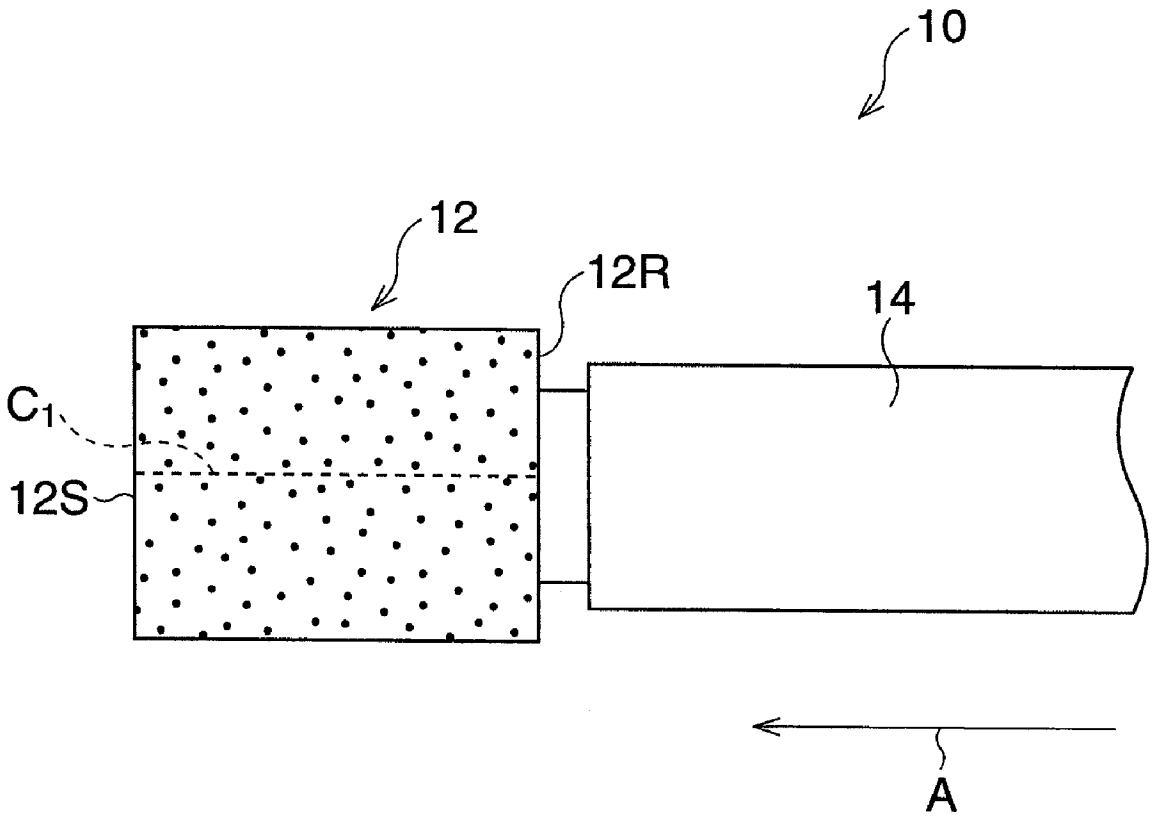
FIG. 2B is a side view of the front end of the cleaning tool of the first embodiment.
Figure 2A:
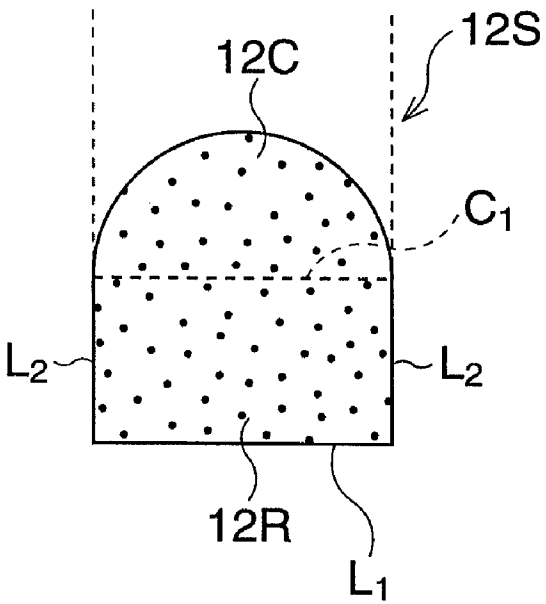
FIG. 2A is a front view of the front end of the cleaning tool of the first embodiment.

A cleaning tool 10 is used for cleaning a surface of a member of a photographic device such as a digital camera, that is, a surface of an imaging device, a low-pass filter, a light-receiving surface of a protection filter, a photographing lens, an eyepiece lens, a view finder, or other devices (not shown); by removing foreign matter, such as dust, attached to such a surface. In the first embodiment, as represented in FIGS. 1, 2A, and 2B, the cleaning tool 10 includes an adhesive member 12 to which the foreign matter adheres, and which is made of butyl rubber, and a body 14 which has a stick shape and which is made from resin or other materials. The adhesive member 12 is attached to the front end of the body 14 (see FIGS. 1 and 2B for a side view). Because the body 14 is long and a user can easily hold the rear end thereof, an imaging device and other components provided deep inside a photographic device can be easily cleaned by the cleaning tool 10. That is, the adhesive member 12 can be reliably placed on a surface to be cleaned.

When the adhesive member 12 is pressed onto a surface to be cleaned by a user holding the body 14, foreign matter on the surface adheres to the adhesive member 12. Thus, by removing the adhesive member 12 from the surface to be cleaned after the foreign matter adheres thereto, the foreign matter is removed from the surface.

At the end of the adhesive member 12, an adhesive surface 12S for foreign matter to adhere to, is provided. The adhesive surface 12S includes an arcuate area 12C of which part of the outline is arcuate, and a rectangular area 12R that has a rectangular shape and is situated next to the arcuate area 12C (see FIG. 2A for a front view).

In the first embodiment, the arcuate area 12C has a semicircular shape, and a linear section of the outline of the arcuate area 12C and one of the sides of the rectangular area 12R are coincident to each other, as represented by the broken line. That is, the length of a long side $L_1$ is the same as the length of the theoretical diameter $C_1$ of a circle including the arcuate area 12C.

By forming the adhesive surface 12S whereby the linear section of the outline of the arcuate area 12C is coincident with the side of the rectangular area 12R, as explained above, the structure of the adhesive member 12 with the two areas in the adhesive surface 12S, can be simplified. The arcuate area 12C is located between two theoretical lines which extend from either end of two short sides $L_2$, provided at opposite sides of the rectangular area.

The adhesive surface 12S is perpendicular to the longitudinal direction in which the body 14 extends, as the arrow A represents. The adhesive member 12 has a pillar shape where the two ends are the adhesive surface 12S, and an end surface 12R which has a similar shape to that of the adhesive surface 12S. Therefore, the sectional shape of the adhesive member 12 taken along a plane perpendicular to the longitudinal direction of the body 14 is a similar shape to the shape of the adhesive surface 12S, regardless of the position where the section is taken. Further, the adhesive surface 12S may have the same shape as that of the end surface 12R.

Figure 3:
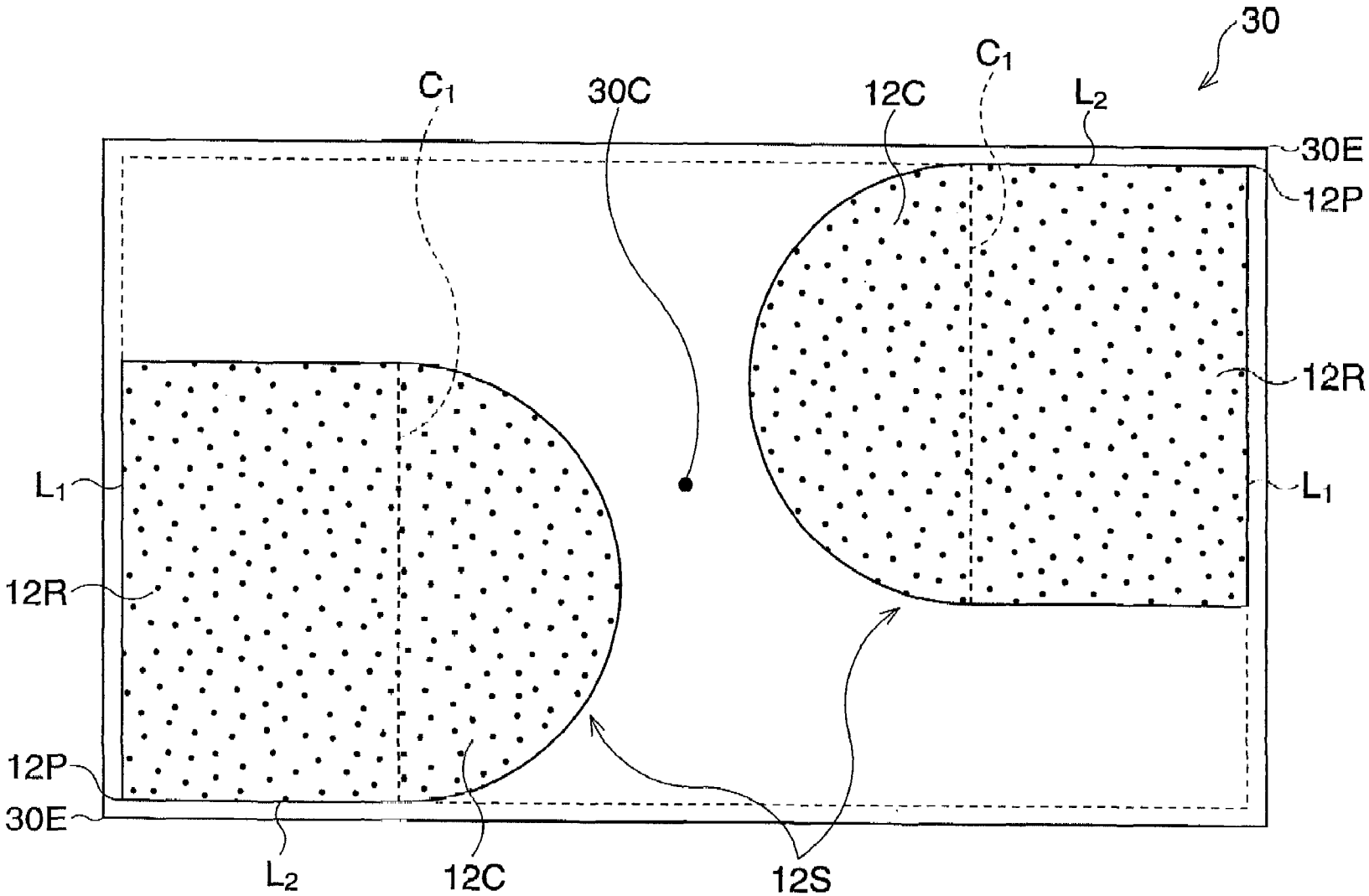
FIG. 3 is a conceptual view representing the adhesive surface of the cleaning tool placed on a surface of a low-pass filter in a cleaning operation.

When the cleaning tool 10 is used for cleaning a low-pass filter (hereinafter named LPF) 30, the adhesive surface 12S is pressed onto a surface of the LPF 30 having a rectangular shape (see FIG. 3). Note that in FIG. 3, and FIG. 4 which follows FIG. 3, the size of the adhesive surface 12S is enlarged against the sizes of the members to be cleaned, for convenience of explanation. To clean the peripheral area close to the corner points 30E of the surface of the LPF 30, the rectangular area 12R is used as represented in FIG. 3.

This is effective because foreign matter located in the peripheral area close to the corner points 30E of the surface of the LPF 30 can easily and efficiently adhere to the rectangular area 12R that has the same outline shape as that of the peripheral area, as well as foreign matter located around the center point 30C of the surface of the LPF 30. That is, the long side $L_1$ and the short side $L_2$, which intersect at right angles, can be easily fit into the corner of the LPF 30, whose two sides also intersect with each other at right angles at the corner point 30E. However, if the arcuate area 12C, which has a different outline shape to that of the peripheral area of the surface of the LPF 30, is used, picking up foreign matter from the peripheral area is difficult.

In the case that the adhesive member 12 can be freely moved around the surface and surrounding area of the LPF 30 of an imaging device unit, it is possible to efficiently pick up foreign matter from the area around the corner points 30E of the LPF 30 by using the arcuate area 12C. However, inside a digital camera, many other members are generally arranged around the imaging device unit, which results in the adhesive member 12 not being able to be maneuvered easily in the area around the LPF 30 due to obstruction by other members. Therefore, using the rectangular area 12R is required to clean the area of the surface of the LPF 30 around the corner points 30E as previously mentioned, by keeping the whole area of the adhesive surface 12S in contact with the surface of the LPF 30.

On the adhesive surface 12S of the first embodiment, the arcuate area 12C is provided between two theoretical lines which extend from two adjoining sides of the rectangular area 12R; that is, the long side $L_1$ and the short side $L_2$, and which are represented as broken lines. Therefore, when the adhesive surface 12S is placed on the LPF 30 so that the vertex 12P of the adhesive surface 12S is almost coincident with the corner point 30E, the arcuate area 12C does not overlap to the outside of the surface of the LPF 30 and is not obstructed by other members.

Figure 4:
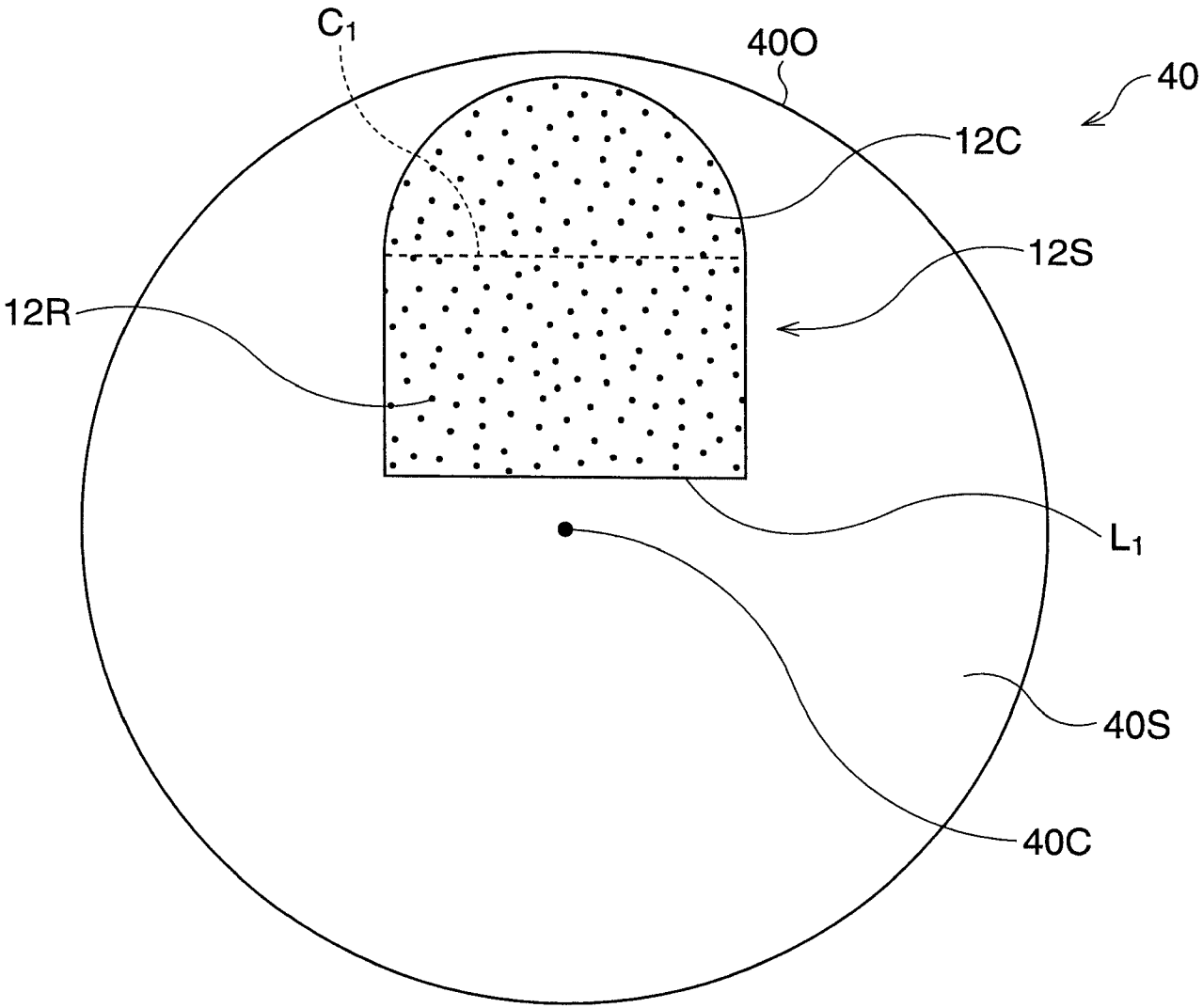
FIG. 4 is a conceptual view representing the adhesive surface of the cleaning tool placed on a surface of a photographing lens in a cleaning operation.

On the other hand, in the case where the cleaning tool 10 is used to clean, for example, a photographing lens 40 that has a circular surface 40S, when the periphery of the circular surface 40S of the photographing lens 40, that is; the area in the vicinity of the outline 40O of the circular surface 40S, is the subject of cleaning, the arcuate area 12C is used (see FIG. 4). In this case, the adhesive surface 12S can be moved around the circular surface 40S of the photographing lens 40, keeping the arcuate area 12C facing the outline 40O.

The reason for using the arcuate area 12C to clean the peripheral area near the outline 40O and away from the center point 40C of the circular surface 40S is, that foreign matter in the peripheral area around the outline 40O can be easily and efficiently adhered to the arcuate area 12C due to it having the similar shape to the outline 40O. Further, the edge of the circular surface 40S can be well observed even when the adhesive surface 12S is adhered near the outline 40O, so foreign matter on the edge of the circular surface 40S can be easily removed. This is because that the radius of curvature of the arcuate area 12C is sufficiently smaller than that of the circular surface 40S.

On the other hand, if the rectangular area 12R, which has a different shape from the outline 40O, is used, adhering foreign matter in the peripheral area near the outline 40O is difficult due to an area immediately next to the outline 40O being unreachable because of the linear sides of the rectangular area 12R.

In the first embodiment explained above, it is possible to efficiently clean various members provided in a photographing device, by using the rectangular area 12R and the arcuate area 12C, either of which can be selectively used according to the shape of the surface to be cleaned.

Figure 5B:
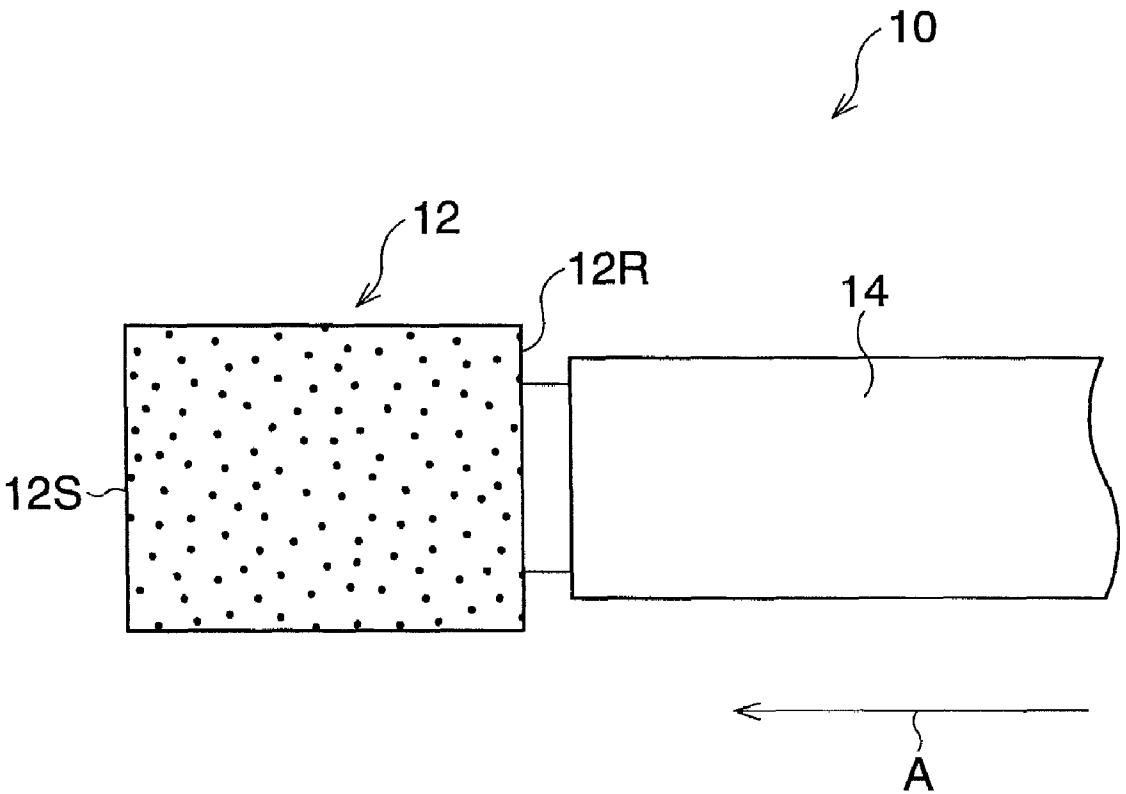
FIG. 5B is a side view of the cleaning tool of the second embodiment.
Figure 5A:
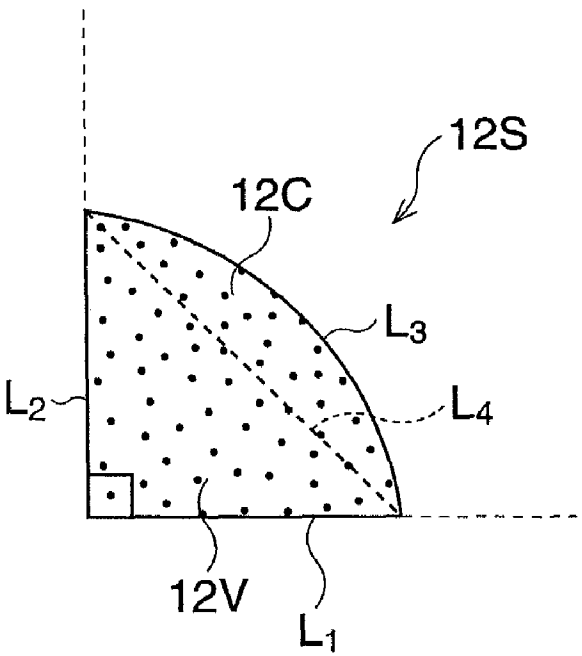
FIG. 5A is a front view of the cleaning tool of the second embodiment.

Next, the second embodiment is explained referring to FIGS. 5A and 5B. Note that in FIGS. 5A and 5B, components common to those in the first embodiment have the same reference numerals.

In the second embodiment, the shape of the adhesive member 12 is different from that in the first embodiment. That is, in the second embodiment, the adhesive surface 12S includes a right-angle area 12V and an arcuate area 12C. The outline of the right-angle area 12V includes two sides $L_1$ and $L_2$ which are adjacent to the right angle. The outline of the arcuate area 12C includes an arcuate line $L_3$, which is a curved line connected to both ends of the sides $L_1$ and $L_2$. That is, either end of the arcuate line $L_3$ connects to the opposite end to the right angle of both the two sides $L_1$ and $L_2$ of the right-angle area 12V. The arcuate area 12C, which is next to the right-angle area 12V, is located between two theoretical lines represented as the broken lines, each extending from the sides $L_1$ and $L_2$ away from the right-angle.

In the second embodiment, as explained above, by providing the right-angle area 12V and the arcuate area 12C either of which can be selectively used according to the shape of the surface to be cleaned, as in the first embodiment, it is possible to efficiently clean various members located in a photographing device.

That is, when the rectangular surface of the LPF 30 (see FIG. 3) is to be cleaned, the right-angle area 12V is mainly used. In this case, because the arcuate area 12C is between the theoretical lines extending from the sides $L_1$ and $L_2$, it is possible to clean the area around the corner points 30E on the surface of the LPF 30, while keeping the whole area of the adhesive surface 12S in contact with the surface of the LPF 30, as in the first embodiment. On the other hand, when the circular surface of the photographing lens 40 (see FIG. 4) is to be cleaned, foreign matter on the area near the outline 40O can be reliably removed by orientating the adhesive surface 12S so that the arcuate area 12C is next to the outline 40O.

Figure 6B:
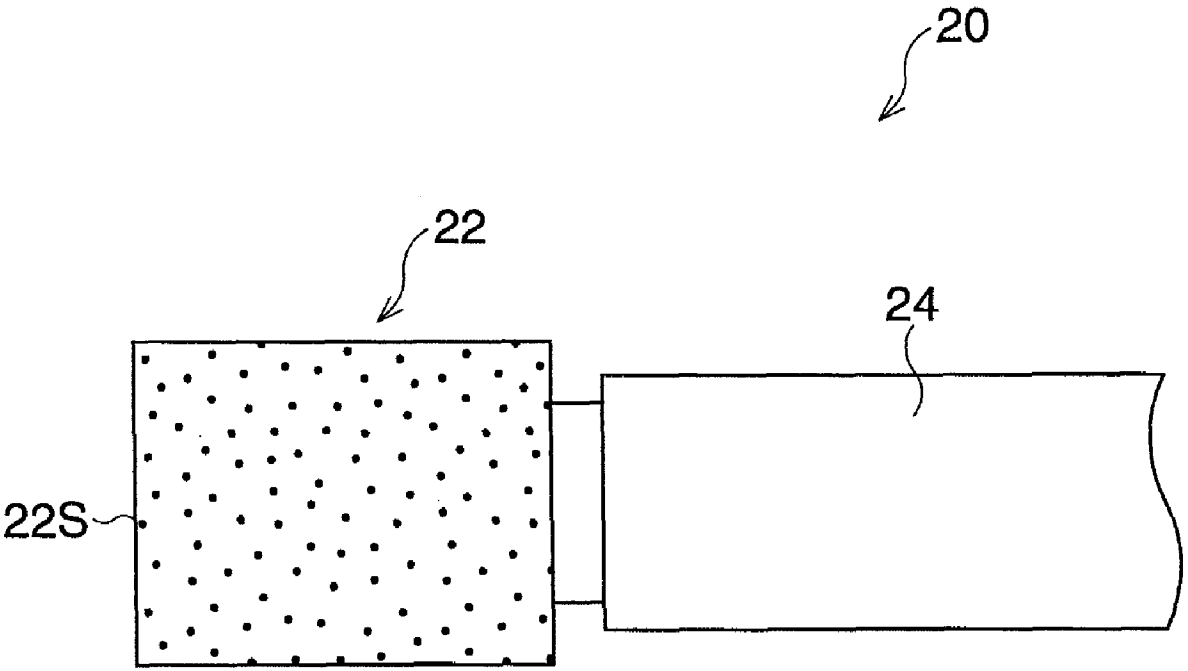
FIG. 6B is a side view of the front end of the cleaning tool of a comparative example.
Figure 6A:
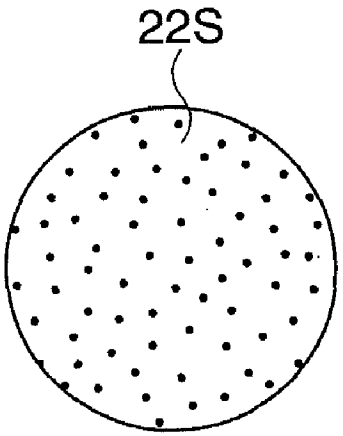
FIG. 6A is a front view of the front end of the cleaning tool of a comparative example.

Next, a comparative example of the cleaning tool 20 is explained by referring to FIGS. 6A and 6B. In the cleaning tool 20 of the comparative example, a column shaped adhesive member 22 is attached to a body 24, of which the adhesive surface 22S has a circular shape. Therefore, when the area around the corner points 30E of the rectangular surface of the LPF 30 is to be cleaned (see FIG. 3), foreign matter cannot be reliably removed therefrom by the cleaning tool 20, differing from the cleaning tool 10 in the first and second embodiments.

Note that the shape, etc., of the members included in the cleaning tool 10 are not limited to those in the aforementioned embodiments. For example, on the adhesive surface 12S, the arcuate area 12C may have a sector shape, an oval shape, or a part thereof, other than the semicircular shape in the first embodiment, or the arcuate shape of a section of an exact circle in the second embodiment. In terms of the rectangular area 12R, it may have a square shape, or a quadrangle shape having two sides orthogonal to each other. In the right-angle area 12V (see FIG. 5A), for example, the lengths of the sides $L_1$ and $L_2$ may be adjusted. Further, only a part of an opposite side of the long side $L_1$ of the rectangular area 12R (see FIG. 2A) or a side $L_4$ of the right-angle area 12V (see FIG. 5A) may be coincident with the linear section of the outline of the arcuate area 12C.

In terms of the members included in the cleaning tool 10, their sizes may be adjusted according to the size and shape of the surface to be cleaned, and so on. For example, although the cleaning tool 10 in the first embodiment is preferable to that of the second embodiment in terms of the size of the area of the adhesive surface 12S when the lengths of the outlines of the first and second embodiments are the same as each other, the area of the adhesive surface 12S can be expanded or adjusted in the second embodiment.

Further, the materials of members in the cleaning tool 10 are not limited to those in the embodiments. For example, the adhesive member 12 may be formed by a urethane type resin having adhesiveness, a styrene type resin, or so on, as an alternative to the butyl rubber of the embodiments.

Finally, it will be understood by those skilled in the art that the foregoing description is of preferred embodiments of the apparatus, and that various changes and modifications may be made to the present invention without departing from the spirit and scope thereof.

The present disclosure relates to subject matters contained in Japanese Patent Application No. 2006-194343 (filed on Jul. 14, 2006), which is expressly incorporated herein, by reference, in its entirety.

The invention claimed is:

1. A cleaning tool for removing foreign matter from a surface of a photographic device, said cleaning tool comprising:

an adhesive member that has an adhesive surface provided at a distal most end surface of said adhesive member for said foreign matter to adhere to; and a body that has an end to which said adhesive member is attached, said adhesive surface having an arcuate area of which part of the outline is an arcuate section and a rectangular area that has a rectangular shape and is coplanar to said arcuate area, said arcuate area being located between two theoretical lines which extend from two adjoining sides of said rectangular area, wherein said adhesive surface is in a plane perpendicular to the direction that said body extends and faces a direction opposite the direction that said body extends.

2. The cleaning tool according to claim 1, wherein the outline of said arcuate area further comprises a linear section, and said linear section is coincident with a side of said rectangular area.

3. The cleaning tool according to claim 1, wherein said arcuate area has a semicircular shape.

4. The cleaning tool according to claim 1, wherein the sectional shape of said adhesive member taken along a plane perpendicular to the longitudinal direction of said body is a similar shape to the shape of said adhesive surface.

5. The cleaning tool according to claim 1, wherein said body has a stick shape and is a holding part to be held by a user.

6. A cleaning tool to remove foreign matter from a surface of a photographic device, said cleaning tool comprising:

an adhesive member that has an adhesive surface provided at a distal most end surface of said adhesive member for said foreign matter to adhere to; and a body that has an end to which said adhesive member is attached, said adhesive surface having an arcuate area of which part of the outline is an arcuate section and a right-angle area that has a right angle, said arcuate area being coplanar to said right-angle area on said distal most end surface and between two theoretical lines which extend from two sides of said right-angle area which are adjacent to the right angle, wherein said adhesive surface is in a plane perpendicular to the direction that said body extends and faces a direction opposite the direction that said body extends.

7. The cleaning tool according to claim 6, wherein either end of said arcuate section connects to the opposite end to the right angle of both said two sides of said right-angle area.

8. A cleaning tool for removing foreign matter from a surface of a photographic device, said cleaning tool comprising:

an adhesive member that has an adhesive surface provided at a distal most end surface of the adhesive member for said foreign matter to adhere to; and a body that has an end to which said adhesive member is attached, said adhesive surface having an arcuate area of which part of the outline is an arcuate section and a rectangular area that has a rectangular shape and is coplanar to said arcuate area, said arcuate area being located between two theoretical lines which extend from either end of two opposite sides of said rectangular area, wherein said adhesive surface is in a plane perpendicular to the direction that said body extends and faces a direction opposite the direction that said body extends.

* * * * *